US007104756B2

(12) United States Patent
Harding et al.

(10) Patent No.: US 7,104,756 B2
(45) Date of Patent: Sep. 12, 2006

(54) TEMPERATURE TOLERANT VANE ASSEMBLY

(75) Inventors: Benjamin R. Harding, Ellington, CT (US); Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 87 days.

(21) Appl. No.: 10/916,682

(22) Filed: Aug. 11, 2004

(65) Prior Publication Data

US 2006/0034679 A1 Feb. 16, 2006

(51) Int. Cl.
*F01D 5/18* (2006.01)

(52) U.S. Cl. ..... 416/96 A; 416/233

(58) Field of Classification Search ..... 415/115, 415/191, 168.4, 174.2; 416/96 A, 226, 233
See application file for complete search history.

(56) References Cited

U.S. PATENT DOCUMENTS

| | | | | |
|---|---|---|---|---|
| 2,847,185 | A * | 8/1958 | Petrie et al. | 415/115 |
| 3,378,228 | A | 4/1968 | Davies et al. | 253/39.1 |
| 4,076,451 | A | 2/1978 | Jankot | 415/217 |
| 4,221,540 | A | 9/1980 | Savonuzzi | 416/97 R |
| 4,314,794 | A | 2/1982 | Holden et al. | 416/97 A |
| 4,396,349 | A | 8/1983 | Hueber | 415/115 |
| 4,473,336 | A | 9/1984 | Coney et al. | 416/96 R |
| 4,563,128 | A | 1/1986 | Rossmann | 416/92 |
| 4,773,824 | A | 9/1988 | Kiss | 416/168 |
| 4,798,515 | A * | 1/1989 | Hsia et al. | 415/115 |
| 5,630,700 | A * | 5/1997 | Olsen et al. | 415/134 |
| 6,000,906 | A | 12/1999 | Draskovich | 415/209.4 |
| 6,102,610 | A * | 8/2000 | Palusis et al. | 403/388 |
| 6,164,903 | A | 12/2000 | Kouris | 415/135 |
| 6,193,465 | B1 * | 2/2001 | Liotta et al. | 416/96 A |

FOREIGN PATENT DOCUMENTS

| | | |
|---|---|---|
| EP | 1052373 | 11/2000 |
| EP | 1284338 | 2/2003 |
| FR | 1483484 | 6/1967 |
| GB | 2386926 | 10/2003 |

OTHER PUBLICATIONS

European Search Report for European Patent Application 05253604.2.

* cited by examiner

*Primary Examiner*—Edward K. Look
*Assistant Examiner*—Nathan Wiehe
(74) *Attorney, Agent, or Firm*—Kenneth C. Baran

(57) ABSTRACT

A vane assembly 10 suitable for a turbine engine features a refractory vane 12 with an internal cavity 20 and a pair of flexible metallic baffles 26 extending into the cavity from spanwisely opposite ends of the vane. A rigid fastener 48, such as a nut and bolt assembly applies a tensile load to the baffles. The tensile load is reacted out as a compressive load applied to the vane. In another embodiment, the baffle is relatively rigid but the fastener is flexible. The compressive loading exerted on the vane counteracts the brittleness customarily exhibited by refractory materials and imparts damage tolerance to the vane. The arrangement also allows the use of a metal baffle that can be easily secured to the vane and dispenses with any need for a potentially troublesome seal between the baffles and the spanwise extremities of the vane.

15 Claims, 2 Drawing Sheets

TEMPERATURE TOLERANT VANE ASSEMBLY

STATEMENT OF GOVERNMENT INTEREST

This invention was made under U.S. Government Contract F-33615-97-C-2779. The Government has certain rights in the invention.

TECHNICAL FIELD

This invention relates to a vane assembly of the type useful in gas turbine engines, and particularly to a vane assembly including a tensioned baffle assembly that applies a compressive load to the vane.

BACKGROUND OF THE INVENTION

Fluid directing vanes, such as those used in the turbine modules of gas turbine engines, are exposed to hot, gaseous combustion products. Various measures are taken to protect the vanes from the damaging effects of the hot gases. These include making the vane of temperature tolerant nickel or cobalt alloys, applying thermal barrier coatings to the vanes, and cooling the vanes with relatively cool, pressurized air extracted from the engine compressor.

Conventional cooling techniques include impingement cooling. An impingement cooled vane has an internal cavity and a sheet metal coolant insert or baffle residing in the cavity but spaced a small distance from the cavity wall. The space between the baffle and the cavity wall is referred to as an impingement space. The baffle, which is usually made of a nickel alloy, is welded to the vane near the spanwise extremities of the vane. The weld joint secures the baffle to the vane and also seals the spanwise extremities of the impingement cavity. Numerous impingement cooling holes perforate the baffle. During engine operation, coolant enters the interior of the baffle and then flows through the impingement cooling holes, which divide the coolant into a multitude of high velocity coolant jets. The coolant jets impinge on the cavity wall to keep the wall cool. The coolant then discharges from the impingement cavity, customarily by way of coolant discharge passages that penetrate the cavity wall.

Despite the many merits of the above mentioned alloys, coatings and cooling techniques, it is desirable to further improve the temperature tolerance of turbine engine vanes to extend their useful life or to allow the engine to operate at higher internal temperatures, which improves engine performance. One way to improve the temperature tolerance is to construct the vanes of a refractory material. Refractory materials include refractory metal alloys (such as molybdenum and niobium alloys) ceramics, and compositions comprising intermetallic compounds. However these materials are susceptible to cracks because they are brittle at some or all temperatures.

In addition, although refractory materials exhibit better temperature tolerance than nickel or cobalt alloys, it may still be necessary to employ impingement cooling using a conventional metal baffle as already described. A conventional metal baffle is desirable, even in a vane made of refractory material, for at least two reasons. First, conventional baffle alloys have a higher coefficient of thermal expansion than do the refractory materials, but are exposed to lower temperatures during engine operation. Consequently, the thermal response of the conventional metal baffle will be compatible with that of the refractory vane. Second, a conventional metal baffle, unlike a refractory baffle, can be perforated with impingement cooling holes without suffering any appreciable loss of structural integrity.

Unfortunately, a conventional metal coolant baffle cannot be welded to a refractory vane in order to secure the baffle to the vane and seal the ends of the impingement cavity. In principle, the problem of sealing the ends of the impingement cavity could be overcome by using a seal made of a compliant material. In practice, however, such seals are incapable of withstanding the extreme temperatures and/or the mechanical abuse (e.g. vibration and chafing) encountered in a turbine engine. Moreover, even if a suitable seal material were available, it would not, by itself, address the problem of securing the metal baffle to the ceramic vane.

What is needed is a coolable, highly temperature tolerant vane assembly that exhibits good crack resistance, is capable of accepting a metal baffle, and is achievable without requiring the use of materials unsuitable for a harsh thermal and mechanical environment.

SUMMARY OF THE INVENTION

According to one embodiment of the invention, a vane assembly includes a vane with an internal cavity and with baffles extending into the cavity from opposite ends of the vane. A tensile load applied to the baffles helps anchor the baffles to the vane and effect a seal between the baffles and the vane. A compressive load applied to the vane helps optimize the stress distribution to compensate for any brittleness in the material used to make the vane.

In a more detailed embodiment of the invention, a fastener connects the baffles to each other. The baffles are relatively flexible in comparison to the fastener. The fastener applies a tensile load that anchors the baffles to the vane and also deflects the baffles to effect a seal between the baffles and the vane.

The foregoing and other features of the various embodiments of the invention will become more apparent from the following description of the best mode for carrying out the invention and the accompanying drawings.

BEST MODE FOR CARRYING OUT THE INVENTION

Figure 1:
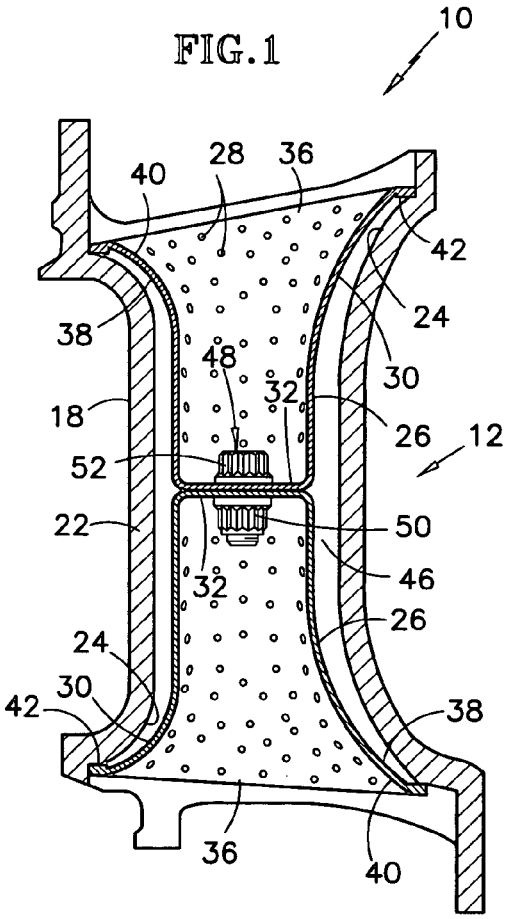
FIG. 1 is a cross sectional side elevation view of a turbine vane assembly for a turbine engine.
Figure 2:
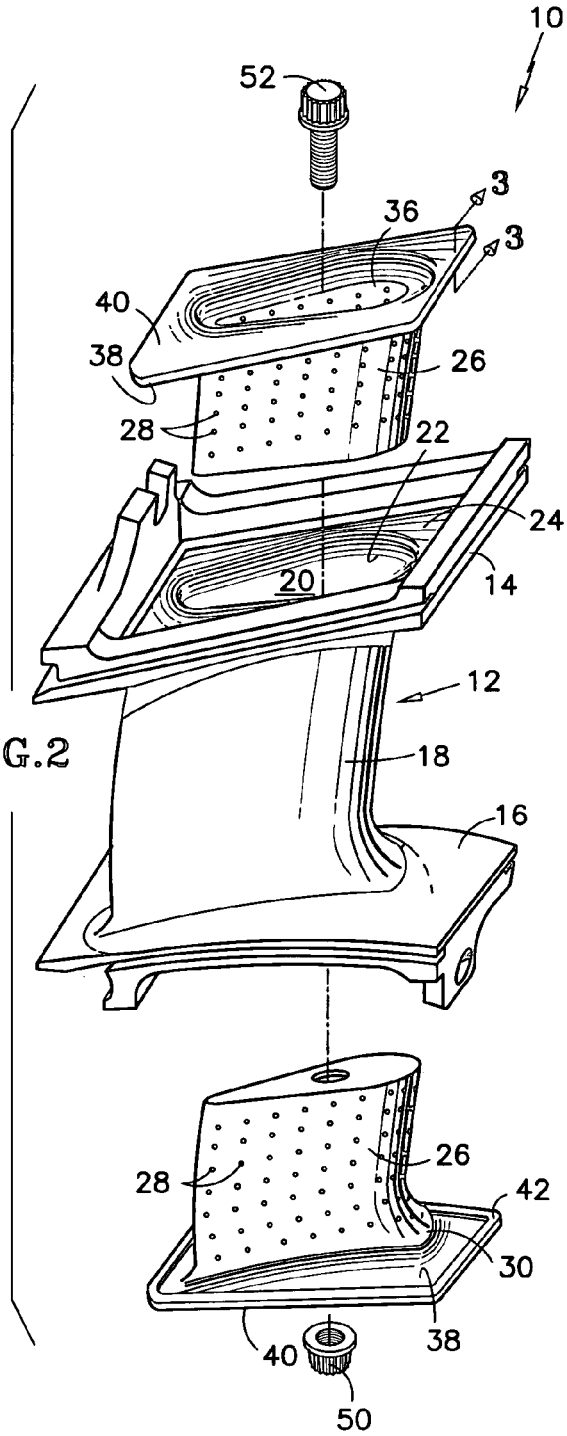
FIG. 2 is an exploded perspective view of the vane assembly of FIG. 1 showing a vane, a pair of baffles and a fastener assembly.
Figure 3:
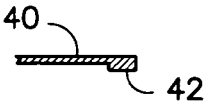
FIG. 3 is a view in the direction 3—3 of FIG. 2.

Referring to FIGS. 1–3 a vane assembly 10 for a turbine engine includes a vane 12 having a first or radially outer platform 14 and a second or radially inner platform 16. The identification of the platforms as radially outer and inner platforms reflects the orientation of the vane when installed in a turbine module of a gas turbine engine. An airfoil 18 extends spanwisely between the platforms. An airfoil shaped internal cavity 20 bounded by vane wall 22 extends spanwisely through the airfoil. The cavity has flared portions 24 at its spanwise extremities as seen best in FIG. 1. The vane is made of a refractory material such as a refractory metal alloy, a ceramic, or a composition comprising intermetallic compounds.

A metal baffle assembly includes first and second (radially outer and inner) baffles 26 each made of a nickel base alloy. Numerous impingement holes 28 perforate the baffles. Each baffle is airfoil shaped along most of its spanwise length and also has a flared proximal end 30, similar in shape to the flared portions 24 of the vane cavity, and a squared-off remote end 32. A coolant inlet 36 permits coolant to flow into the interior of each baffle. Each flared end 30 has an inboard surface 38 and an outboard surface 40 that face respectively toward or away from the cavity 20 when the baffle is installed in the vane. A raised border 42 extends around the perimeter of each inboard surface 38. The raised border may be formed in any suitable way, for example as an integral feature of the baffle or as a coating of prescribed thickness applied locally to the perimeter of the inboard surface. In a finished vane assembly, the baffles nest inside the vane cavity 20 as seen best in FIG. 1 with the baffle proximal ends 30 proximate the spanwise extremities of the vane and the baffle remote ends 32 remote from the spanwise extremities. The borders 42 contact the flared portion of the cavity. The baffles cooperate with vane wall 22 to define an impingement cavity 46 that circumscribes the baffles.

Figure 4:
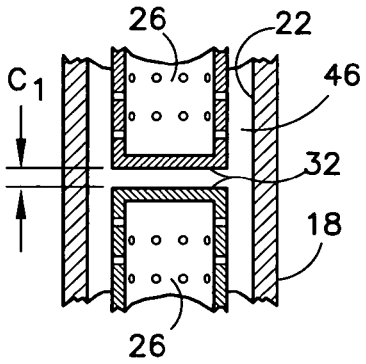
FIG. 4 is a view showing the remote ends of flexible baffles as initially placed in the vane but before having been connected to each other.
Figure 5:
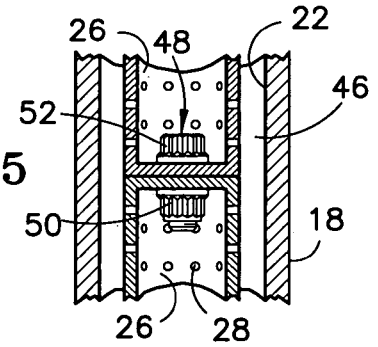
FIG. 5 is a view showing the remote ends of flexible baffles connected to and in contact with each other.
Figure 6:
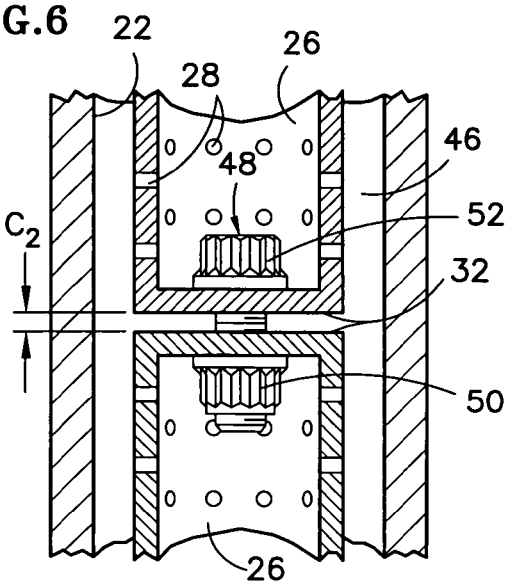
FIG. 6 is a view similar to FIG. 5 showing an alternate configuration with the baffles connected to each other but out of contact with each other.

A fastener 48, such as a nut and bolt assembly, connects the baffles to each other. One embodiment of the invention includes sheet metal baffles that are relatively flexible in comparison to the fastener, which is relatively rigid in comparison to the baffles. When the baffles are initially placed in the airfoil cavity, the baffle remote ends 32 are spanwisely spaced from each other by an inter-baffle clearance space $C_1$ (FIG. 4). However when nut 50 is torqued onto bolt 52, the baffle deflects, particularly at the flared proximal end 30, until the remote ends 32 contact each other as seen in FIGS. 1 and 5. As a result, the fastener applies a spanwisely directed tensile load to the baffle assembly which, in turn, applies a spanwisely directed compressive load to the vane. The magnitude of the tensile and compressive loads can be accurately regulated by appropriate choice of baffle material, thickness and geometry and by the initial inter-baffle clearance space $C_1$. Alternatively, the nut may be torqued onto the bolt only enough to reduce the interbaffle clearance from initial value $C_1$ to a prescribed non-zero value $C_2$ as seen in FIG. 6. This variant of the invention is believed to result in less accurate control of the tensile and compressive loads because those loads depend in part on the difference between $C_1$ and $C_2$, a difference that may be difficult to control in practice.

Figure 7:
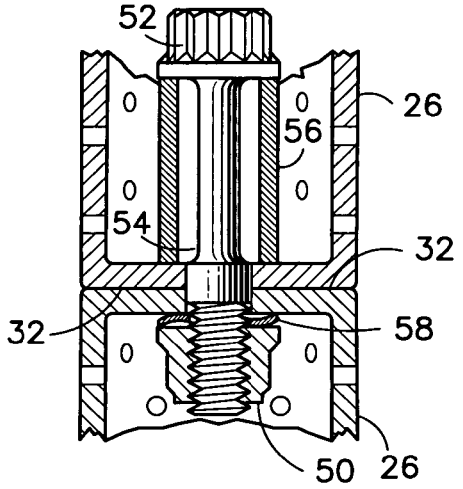
FIG. 7 is a view similar to FIG. 5 showing various flexible fasteners useful for connecting relatively rigid baffles to each other.

FIG. 7 illustrates an alternative embodiment in which the baffles are relatively rigid in comparison to the fastener, which is relatively flexible in comparison to the baffles. In this embodiment the remote ends 32 of the baffles may be in contact with each other as seen in FIG. 7 or may be out of contact with each other so that an interbaffle space is present even after the fastener is tightened. The illustration depicts three ways for introducing flexibility into a fastener comprising a nut and bolt assembly. First, the shank of bolt 52 may be flexible enough to elastically deform in response to torque applied to the fastener. The deformability of the bolt may be enhanced by employing a neck 54 of reduced cross sectional area. Second, an elastically deformable spacer 56 may be interposed between the nut and/or bolt and the baffle. Third, a wave washer 58 or other suitable spring device may be interposed between the nut and/or bolt and the baffle. Although FIG. 7 depicts all these features, they would ordinarily be used individually, not in combination.

During engine operation, coolant enters each of the coolant inlets 36, flows through the impingement holes 28 and impinges on the vane wall 22 to impingement cool the vane. The coolant then discharges from the impingement cavity by way of coolant outlets, not shown, which customarily take the form of passages that penetrate the vane wall 22.

With the most salient features having now been described, other features and options may now be better appreciated.

Because the illustrated baffles 26 are of approximately equal spanwise length, their remote ends 32 and the fastener 58 reside at approximately the mid-span of vane cavity 20. However unequal baffle lengths and other spanwise locations of the fastener may also be satisfactory.

The illustrated embodiments employ a nut and bolt assembly as a fastener for connecting the baffles to each other. However other types of fasteners such as rivets, weld joints or braze joints may also be employed.

Figure 8:
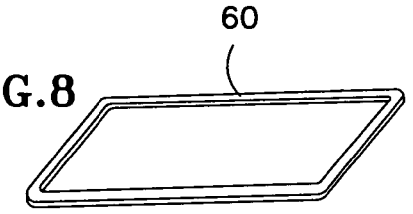
FIG. 8 is a seal suitable for being interposed between the vane and baffles in an alternate embodiment of the invention.

In an alternative design, an individual spacer 60 as depicted in FIG. 8 may be used in lieu of a raised border 42 along the perimeter of each inboard surface. In yet another embodiment neither an individual spacer nor a raised border is present, substantially eliminating at least part of the impingement cavity 46 near the spanwise extremities of the airfoil.

The disclosed vane assembly has several advantages. First, the tensile load applied to the baffle assembly securely anchors the baffle assembly to the vane without a weld joint. The corresponding compressive load exerted on the vane improves the stress distribution in the vane by mitigating the tensile stresses. This makes the vane less vulnerable to cracking and helps ensure the integrity of the vane if cracking nevertheless occurs. As a result, the vane can be made of temperature tolerant but brittle refractory materials. The tensile load applied to the baffle assembly also seals the spanwise extremities of the impingement cavity 46 to prevent coolant from entering the cavity without first passing through the impingement holes. Moreover, this seal is effected without using seal materials unable to tolerate the vibration, chafing and extended exposure to high temperatures.

Another advantage is best appreciated by first referring to U.S. Pat. Nos. 3,378,228 and 4,314,794, both of which disclose a multi-element ceramic vane with a hollow tube tensioned by a nut secured thereto. The tensile force is reacted out as a compressive force exerted on the vane. Coolant, which is not disclosed as being for impingement cooling, flows through the hollow tube. In both constructions, the coolant must flow past the location of the nut. As a result, the inner diameter of the nut constrains the area of the tube and thus the quantity of coolant that can enter the tube. In principle, a larger nut could be used, however this is frequently impractical in turbine engines or other applications where space is at a premium. By contrast, the fastener 48 of the present invention resides at a location past which coolant is not required to flow. Accordingly, the area of the coolant inlet is not constrained by the maximum acceptable fastener size.

Although this invention has been shown and described with reference to a specific embodiment thereof, it will be understood by those skilled in the art that various changes in form and detail may be made without departing from the invention as set forth in the accompanying claims.

We claim:

1. A vane assembly, comprising:

a vane having first and second ends and an internal cavity;

a baffle assembly including a first baffle extending into the cavity from the first end and a second baffle extending into the cavity from the second end;

the baffles being fastened to each other thereby applying a tensile load to the baffles and a compressive load to the vane and anchoring the baffles to the vane.

2. The vane assembly of claim 1 wherein a fastener connecting the baffles to each other is relatively rigid and the baffle assembly is relatively flexible.

3. The vane assembly of claim 2 wherein each baffle has a proximal end and a remote end and the fastener fastens the baffles to each other such that the remote ends contact each other.

4. The vane assembly of claim 2 wherein the fastener is a nut and bolt.

5. The vane assembly of claim 1 wherein a fastener for connecting the baffles to each other is relatively flexible and the baffle assembly is relatively rigid.

6. The vane assembly of claim 5 wherein the fastener includes at least one of a deformable bolt, a deformable spacer, a spring device and a wave washer.

7. The vane assembly of claim 6 wherein the bolt has a neck.

8. The vane assembly of claim 1 wherein the baffles are made of a relatively flexible material and the vane is made of a relatively brittle material.

9. The vane assembly of claim 8 wherein the baffles are made of a nickel base alloy and the vane is made of a refractory material.

10. The vane assembly of claim 9 wherein the refractory material is selected from the group consisting of refractory metal alloys including molybdenum and niobium alloys, ceramics, and compositions comprising intermetallic compounds.

11. The vane assembly of claim 1, wherein each baffle includes a flared proximal end.

12. The vane assembly of claim 11 including first and second vane platforms and a spacer residing between the flared proximal end of at least one of the baffles and its respective vane platform.

13. The vane assembly of claim 1 wherein the baffles contact each other within the cavity.

14. The vane assembly of claim 1 wherein impingement holes perforate the baffles.

15. A vane assembly, comprising:

a vane having first and second ends and an internal cavity;

a first baffle having a remote end and a flared proximal end, the first baffle extending into the cavity from the first end of the vane;

a second baffle having a remote end and a flared proximal end, the second baffle extending into the cavity from the second end of the vane; and a fastener for bringing the remote ends of the baffles into contact with each other wherein the flared proximal ends of the baffles deflect under the influence of the fastener thereby applying a tensile load to the baffles and a compressive load to the vane.

* * * * *